United States Patent [19]

Termanis

[11] Patent Number: 4,863,191

[45] Date of Patent: Sep. 5, 1989

[54] ARTICLE FOR FORMING A PROTECTIVE COVER

[75] Inventor: Peter Termanis, London, England

[73] Assignee: Adhesive Paper Products Limited, Croydon, United Kingdom

[21] Appl. No.: 216,881

[22] Filed: Jul. 8, 1988

[30] Foreign Application Priority Data

Jul. 20, 1987 [GB] United Kingdom ..... 8717128
Oct. 26, 1987 [GB] United Kingdom ..... 8725010

[51] Int. Cl.[4] ..... B42D 3/00; B42D 3/04; B42D 3/18; B42D 15/00

[52] U.S. Cl. ..... 281/29; 281/4; 281/34; 283/64

[58] Field of Search ..... 281/1, 3, 4, 9, 15, 281/16, 17, 18, 19 R, 29; 283/64; 402/16, 73, 76

[56] References Cited

U.S. PATENT DOCUMENTS

| | | | |
|---|---|---|---|
| 850,735 | 4/1907 | Cummings et al. | 283/64 |
| 961,548 | 6/1910 | Southworth | 283/64 |
| 3,038,742 | 6/1962 | Lead | 281/29 |
| 3,133,750 | 5/1964 | Gerald | 281/29 |
| 4,341,401 | 7/1982 | Arntzen | 281/34 |

FOREIGN PATENT DOCUMENTS

| | | | |
|---|---|---|---|
| 809074 | 5/1951 | Fed. Rep. of Germany | 281/29 |
| 536139 | 11/1955 | Italy | 281/29 |
| 77388 | 5/1917 | Switzerland | 281/29 |
| 1568068 | 5/1980 | United Kingdom . | |
| 2071569 | 9/1981 | United Kingdom . | |

*Primary Examiner*—Douglas D. Watts
*Assistant Examiner*—Paul M. Heyrana, Sr.
*Attorney, Agent, or Firm*—Olson & Hierl

[57] ABSTRACT

An article for forming a protective cover for a book has a first sheet for forming a protective cover with an adhesive coating and a backing sheet. One sheet has delineations facilitating the removal of surplus portions of the first sheet in the regions of the ends of the spine and corners of the book being covered. The spine delineations may be convergent series of regularly spaced parallel lines. The corner delineations may be regularly spaced parallel lines which traverse corner regions. The backing layer is formed as three separately removal portions whereby the book spine and each book cover may be covered in separate steps.

15 Claims, 2 Drawing Sheets

ARTICLE FOR FORMING A PROTECTIVE COVER

BACKGROUND

This invention relates to an article for forming a protective cover for example, for books.

The term "books" is intended to cover not only books but also any article on which a purchaser may wish to use a self-adhesive protective cover such as maps, plans, artwork, photo albums, ring binders, and books which do not exhibit a spine separate from its cover faces.

PRIOR ART

It is known to provide rolls of protective covering material for making protective covers in sufficient lengths to cover several books. Such a material may comprise a flexible plastics sheet carrying a layer of adhesive, and a backing layer which is peelable from the first layer. A printed rectangular grid on the backing layer assists the user in cutting the material to suit the size of book; such a grid is made up of parallel lines in two orthogonal directions which thereby define a pattern of squares.

It is normal to cut the roll such that it has a longitudinal dimension which exceeds that of the book spine. It is then possible to arrange for marginal portions, which are arranged to extend along the free upper and lower edges of the front and back covers, to overlap those free upper and lower edges and for these to also overlap and be adhered to the inside faces of the front and back book covers. The protective cover so formed may be termed a wholly enclosing protective cover. This form of covering is preferred as it creates a more aesthetic appearance and protects all the book cover edges.

Marginal portions of the roll material will overlap the inside faces of the front and back cover along the free upper and lower edges thereof. The removal of the correct amount of surplus material and in the correct place in relation to the spine and corners presents a particular difficulty. It is often this step in a covering operation using roll materials which is performed least satisfactorily. This can spoil the overall result. This and other handling factors lead to the roll form of protective covering material being unattractive to the user.

Another proposal in British Patent No. 1568068 is for a removable book cover but this is not of the kind comprising a first sheet on a removable backing sheet. This proposal sets out to avoid any adhesive attachment between the protective cover and the outer (normally visible) cover faces (including the spine) of the book being covered. Attachment is by means of adhesive tape to the inner (or internal) faces of the book covers.

This disclosure proposes sets of markings which comprise parallel lines of different spacings. These lines are arranged in one vertical array around the spine region, another vertical array adjacent one side, and in a horizontal array in the lower portion of the cover. Their designated purpose is to facilitate the fitting of the cover to books of different sizes. These arrays of markings are not intended to facilitate any other purpose such as the formation of cuts at the marginal portions of the cover in the region of the book spine and the book corners as will hereinafter be described and, indeed, they are not adapted to the purpose.

In British Patent Application No. 2071569A there is a proposal for a book covering which is contoured at its corners so as to pre-define marginal portions thereof. It is dimensioned for a given size of cover. It is intended to be fitted to either a back or a front cover and overlap the spine. By definition, a pair of these coverings are required, one for the front book cover and one for the back book cover. Portions of both coverings overlap the book spine, with one covering overlapping the other covering. It is not intended that the user should cut these coverings at the corners since they are pre-cut. The cutting of this cover by the user at the spine region to provide flaps to be tucked in behind the spine does not arise. It comprises an adhesive backed film having a backing sheet and the spine region of the backing sheet is intended to be removed before the (single) cover portion thereof. It will be appreciated that an individual book covering of this proposal is not intended to be adapted by the user to a range of book sizes.

SUMMARY OF THE INVENTION

It is an object of the invention to provide an article for forming a protective cover for books or like articles which avoids the aforementioned disadvantages of extended roll forms of protective covering material.

It is an object of the invention to provide an article for forming a protective cover for books or like articles which is adapted to be fitted to a range of books of different sizes.

It is an object of the invention to provide an article for forming a protective cover for books or like articles which facilitates the removal of surplus material in the spine marginal regions thereof to enable an advantageous finished appearance in the regions longitudinally of the book spine when fitted.

It is an object of the invention to provide an article for forming a protective cover for books or like articles which facilitates the removal of surplus material in the corner regions thereof to enable an advantageous finished appearance in the corner regions of the book when fitted.

It is an object of the invention to provide an article for forming a protective cover for books or like articles which, in embodiments, facilitates separate removal of portions of the backing sheet to facilitate easier and better application thereof to a book.

It is an object of the invention to provide an article for forming a protective cover for books or like articles which, in embodiments, employs an adhesive which initially enables the user to re-position the book until satisfied that the spine is correctly located.

It is an object of the invention to provide an article for forming a protective cover for books or like articles which is generally easy to use.

It is an object of the invention to provide an article for forming a protective cover for books or like articles which more readily presents an enhanced appearance when fitted.

It is an object of the invention to provide an article for forming a protective cover for books or like articles which is conveniently stored and avoids wastage identified in prior art proposals.

According to one aspect of the present invention there is provided an article for forming a protective cover for a book comprising a protective sheet of flexible material, an adhesive coating extending at least partially over one face of said protective sheet, a removable backing sheet in contact with said adhesive coated face and removable from said protective sheet without removing the adhesive coating, the backing sheet having spine delineations corresponding to range of book sizes, said spine facilitating in use the removal of surplus portions of said protective sheet in the region of the ends of the spine (if present), and the corner delineations facilitating in use the removal of surplus portions of the protective sheet in the region of each corner of the book being covered, wherein said spine delineations which facilitate the removal of surplus portions at the spine comprise a first upper set and second lower set of spine markings each arranged at the spine and cover boundaries, each of said first and second sets of spine markings comprising two series of spine markings, the series of spine markings in each set being arranged at complementary angles, one series being arranged to extend on a back cover area and being directed towards and onto a spine area, the other series being arranged to extend on to a front cover area and being directed towards and onto the spine area.

Further features of the embodiments of the invention are set out in the appended claims (which are incorporated herein by reference). In addition, further features will be apparent from the description of preferred embodiments, modifications of which, within the scope of the appended claims, will be apparent to those skilled in the art.

The invention as claimed has not been limited to the article being in flat-sheet form. It is foreseeable that features which characterize the invention (and facilitate the removal of surplus portions at the spine and corners) may also be applied to an article (intended for covering a single book) sold in roll form. Embodiments herein will disclose the preferred form in which the article is in flat sheet form.

It is found that an article according to the preferred embodiment may be produced in sheets of several sizes, each sheet size being capable of forming a protective cover for a range of book sizes, but in use to cover a single book. It particularly facilitates the formation of marginal cuts in the regions of the spine and corners. When properly formed, these greatly enhance the appearance of the finished article as opposed to the poor appearance which could result previously. One sheet provides a protective cover for one book and several sheets may be sold in a flat package, thereby avoiding the wastage, stock storage and personal storage problems of the roll-form protective cover sold in multiple lengths for covering several books. Furthermore, it is found that this article enables a book to be covered more quickly. It ensures easier handling of the adhesive coated protective sheet. It provides a better quality of finish with fewer air bubbles as compared with protective covers formed from the roll-form of protective cover.

There is the further advantage that the article provided herein is in flat sheet form: this greatly facilitates the fitting operation since it avoids the handling difficulty that arises with rolls which are curled in storage and have a tendency to curl up during the fitting operation. Since each sheet will cover one book, a pack of sheets can be readily stored (e.g. in a drawer). On each occasion that a sheet is removed, it will be in prime condition, i.e. each successively used sheet will be in as good condition as the first sheet.

BRIEF DESCRIPTION OF THE DRAWINGS

An embodiment of the invention will now be described by way of example only with reference to the accompanying drawing, in which.

DETAILED DESCRIPTION OF THE PREFERRED EMBODIMENT

Figure 1:
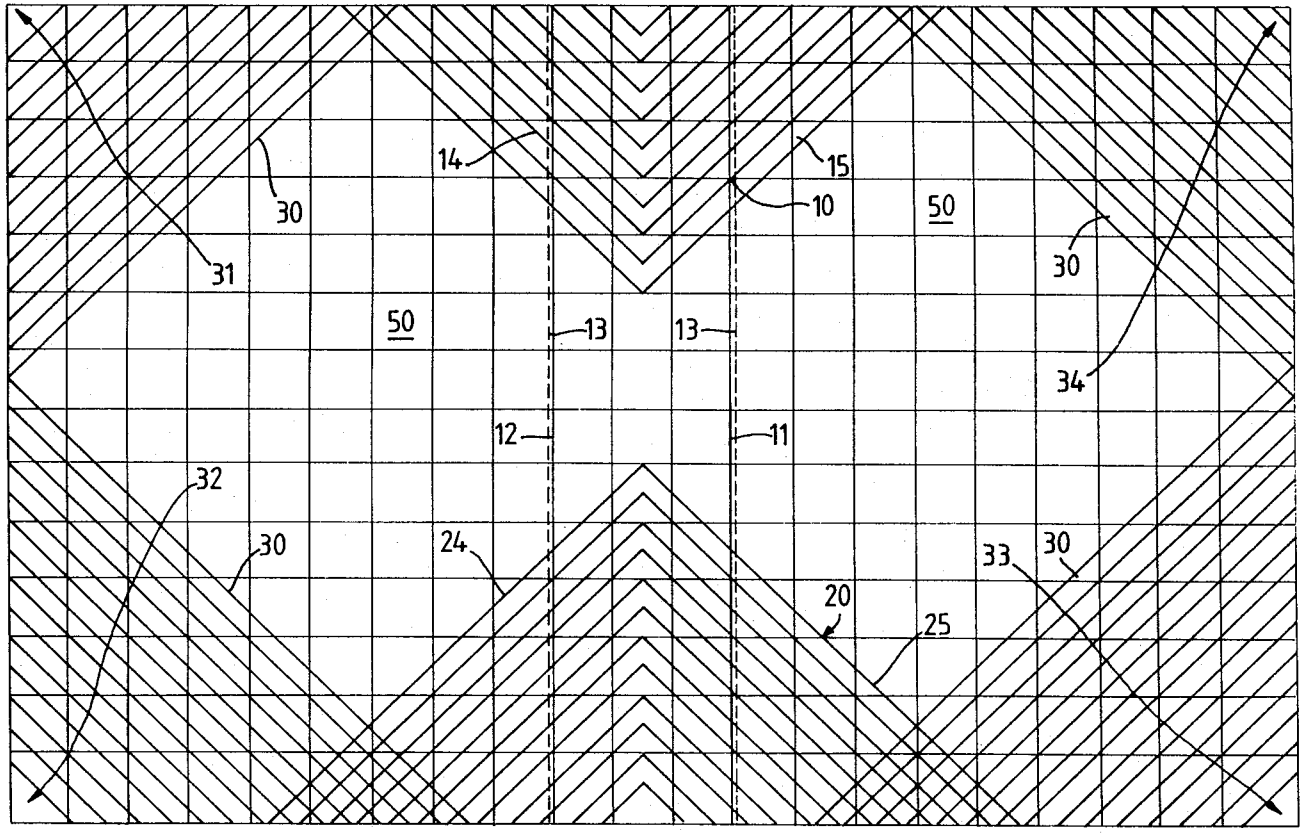
FIG. 1 shows a plan view of an article forming a protective cover in which delineations applied to a removable backing sheet are visible through a transparent protective sheet.
Figure 2:
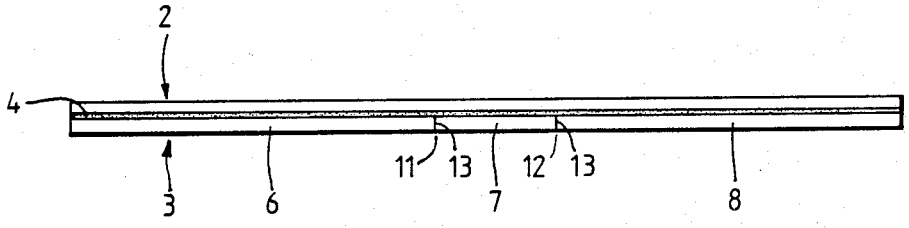
FIG. 2 shows a sectional view of the article of FIG. 1.

In the drawing an article 1 for forming a protective cover is a composite of a protective sheet 2 and a removable backing sheet 3, for example made of paper (FIG. 2). The sheet 2 is formed of a flexible plastics material and is transparent. It is provided with an adhesive coated face 4. Face 4 is disposed in contact with the backing sheet 3. In this embodiment the backing sheet 3 carries spine delineations 10, 20, cover delineations 30 and grid 50 which are visible through the first sheet 1 (FIG. 1). The delineations 10, 20, 30 may be printed on the backing sheet 3. The surface of the backing sheet 3 which contacts the adhesive coated face 4 may be adapted to facilitate its release therefrom. The article 1 is in flat-sheet form and is intended to be made up into a single protective cover.

In this preferred embodiment, the delineations 10, 20, and grid 50 are printed on the backing sheet 3. The backing sheet 3 will accommodate a range of book sizes. As indicated it has three initially integral portions 6, 7, 8 which individually are associated with, and for application to, a front cover, spine and back cover of a book (not shown). These portions 6, 7, 8 are separately removable from the protective sheet 2. The backing sheet 3 is scored or cut at 13 to define the central spine portion 7 which is independently separable from the protective sheet 2. The front cover and rear cover portions 6, 8 thereof are also separately removable.

By comparison with the prior art, this avoids the problems encountered when the user has exposed the adhesive coating on the whole length of a roll (i.e. the length which overlies both book covers and the spine). Such exposure of the whole length combined with the tendency thereof to curl, formerly led to the problem that self-adhesion of the protective sheet tended to occur. By covering the spine first, and then each book cover separately, this problem is avoided.

The backing sheet spine portion 7, which covers the area of the protective sheet 2 to be applied to the book spine, has a width accommodating a range of book spine widths. When applying the article 1 to a book, it is the backing sheet spine portion 7 which is the first of the backing sheet portions 6 to 8 to be removed. With the adhesive coated face 4 of the protective sheet 2 arranged uppermost, the book spine is applied to this exposed area of the protective sheet 2. It may be centered widthwise and longitudinally relative thereto. For this reason it is preferred to select an adhesive coating from the class of adhesives which enables the user to re-position the book until satisfied that the spine is correctly located.

A number of different adhesives may be used. The preferred adhesive is one called a semi-permanent adhesive which forms a bond between the protective sheet 2 and the article being covered. The bond between them is initially weak but it builds up to form a strong bond over a period of time. An alternative adhesive is a peelable adhesive which forms a weak bond with little build up over time. In contrast if a permanent adhesive is used, then greater care must be taken as these immediately form a firm bond between the protective sheet 2 and the article being covered. They do not facilitate adjustment of the book position on the protective covering material 2 after initial contact has been made.

The delineations 10, 20 on the front and rear cover portions 6, 8 of the backing sheet 3 provide visual guidance for making incisions and these incisions facilitate the tucking in of marginal spine portions of the protective sheet 2. These marginal portions project longitudinally of, and at either end of a book spine. This entails removing V-shaped portions of the sheets 2, 3 at the junction of the spine and each cover at both ends of the book. These cover cutting operations would normally be made before applying the spine to the exposed area of the protective sheet 2. The remaining marginal spine portions of the first sheet 2 may then be inserted behind the spine (to the hidden face thereof) if the book binding so permits. Alternatively, these portions may be removed.

Each of the front and rear book covers may then be separately covered by the portions 6, 8. At the free corners of the book (corresponding to the free corners 31 to 34 of the backing sheet), portions of the first and backing sheets 2, 3 are removed. This facilitates the application of marginal portions of the protective sheet 2 to the inside face of the respective cover at the corners thereof. A wholly enclosing protective cover results. Furthermore, delineations 30 on the backing sheet 3 facilitate this removal of the corner surplus. The delineations 30 enable cuts to be made across and just outside each free corner of the front and rear cover portions 6, 8 of the protective and backing sheets 2, 3. These cuts ensure that, when the marginal portions of the sheet 2 are applied to the inside cover face, the marginal portions of the first sheet 2 (from adjacent free edges of the book) abut and exhibit a slightly overlapping mitred finish. The front and rear cover portions of the protective sheet are applied in sequence. For a given cover (front or rear), the backing sheet 3 is removed and the exposed protective sheet 2 is pressed into contact with the outer face of the respective book cover. A hand tool, such as a ruler or roller, may be used to press the protective sheet 2 into contact with the book cover. By moving the tool in a direction from the spine to the outer free lateral edge of the cover, it is possible to ensure a smooth finish free from wrinkles, puckers or air bubbles. The marginal portions may then likewise be applied to the inside face of that book cover, preferably in a clockwise or anti-clockwise sequence so that the overlapping mitred corners are completed successively.

The spine delineations 10, 20, the corner delineations 30 and grid 50 with reference to FIG. 1. A first upper set 10 is arranged at the spine and cover boundaries 11, 12 defined by pre-formed lines 13: these lines 13 may be pre-formed by cutting or scoring. A second lower set 20 is arranged at the spine and cover boundaries 11, 12. A corner set 30 is arranged at each outer corner 31 to 34 of the backing sheet 3 corresponding to the four free corners of the front and back cover portions of the backing sheet (and thus a book to be covered). In addition a conventional grid of squares 50 is provided to facilitate cutting the article (if necessary) to the size required for a given book.

At each spine set 10,20 (upper and lower), the spine delineations comprises two series (14,15 and 24,25) of parallel linear markings which are regularly spaced. The first and second of these series (14,24 and 15,25) having the same spacing and are at complementary angles. One series (15, 25) is arranged to extend on the back cover portion/area 8 and directed towards and onto the spine area 7. The other series (14,24) is arranged to extend on the front cover portion/area 6 and directed towards and onto the spine area 7. The two series are arranged to converge and meet. In use, when a book spine is placed on the spine area 7, the user severs the backing sheet 3 and protective sheet 2 along that pair of convergent delineations (14,15 or 24,25) which pass through the spine/cover junctions of the book. The user extends these cuts only as far along the delineations 14,15 or 24,25 as the position thereon of the respective upper or lower free edge of the book covers. The user can then readily make a further cut which at each such junction converges with the first mentioned cut. This results in four triangular shaped marginal wastage portions, the removal of which facilitates the fitting of the retained marginal portions of the protective sheet 2.

At locations 31 to 34 corresponding to the upper and lower free book cover corners on each of the front and back book covers, the corner sets 30 of corner delineations are located. Each set 30 comprises a series of parallel and regularly spaced lines arranged to traverse such a corner. The backing sheet 3 and protective sheet 2 are severed at each corner along that line 30 which passes just outside the corner. Thus the marginal portions of sheet 2 are so mitred that they slightly overlap when they are applied to the inside face of the respective book cover.

The aforementioned delineations grid 50 of lines (two parallel series in orthogonal directions) also facilitates the alignment or squaring up of the book with the protective book cover 1 (as well as the above-mentioned cutting of the article to reduce its size).

What is claimed is:

1. An article forming a protective cover for a book comprising a protective sheet of flexible material, an adhesive coating extending at least partially over one face of said protective sheet, a removable backing sheet in contact with said adhesive coated face and removable from said protective sheet without removing said Adhesive coating, said backing sheet having spine delineations corresponding to a range of book sizes, said spine delineations and corner delineations facilitating in use the removal of surplus portions of said protective sheet in the region of the ends of, and said corner delineations facilitating in use the removal of surplus portions of said protective sheet in the region of each corner of the book being covered, wherein said spine delineations which facilitate the removal of surplus portions at the spine comprise a first upper set and second lower set of spine markings, each set being arranged at the spine and cover boundaries, each of said first and second sets of spine markings comprising two series of spine markings, the series of spine markings in each set being arranged at complementary angles, one series being arranged to extend on a back cover area and being directed towards and onto a spine area, the other series being arranged to extend on to a front cover area and being directed towards and onto the spine area.

2. An article as claimed in claim 1, wherein said two series of markings in a set of delineations converge and respective pairs thereby meet in the spine area.

3. An article as claimed in claim 1, wherein said spine markings are parallel.

4. An article as claimed in claim 1, wherein there is a regular spacing between said spine markings.

5. An article as claimed in claim 1, wherein said corner delineations which facilitate the removal of surplus portions at the cover corners comprise corner sets of linear markings extending across the respective corner, the corner markings being inclined to the longitudinal and lateral edges of the backing sheet and extending diagonally across the corner regions whereby the corner markings enable a cut to be made near to the corner, which cut is so inclined that the turned in adjoining flaps so formed are mitred.

6. A cover as claimed in claim 5, wherein the linear markings of a corner set are linear and parallel and regularly spaced.

7. An article as claimed in claim 1, wherein the backing sheet comprises three portions for application to a front cover, spine and back cover of a book, said three portions being separately removable from the protective sheet.

8. An article is claimed in claim 7, wherein said three portions are so separately removable by the provision of pre-formed lines defining the boundaries therebetween.

9. An article claim in claim 1, wherein the protective sheet is formed from a layer of plastics material which permits said spine and corner delineations on the backing sheet to be viewed therethrough.

10. An article as claimed in claim 1, wherein the removable backing sheet is formed from paper.

11. An article as claimed in claim 1, wherein said adhesive coating is formed by a semi-permanent adhesive.

12. An article as claimed in claim 1, wherein said adhesive coating is formed by a peelable adhesive.

13. An article in flat-sheet form forming a protective cover for a book comprising a protective sheet of flexible material, an adhesive coating extending at least partially over one face of said protective sheet, a removable backing sheet in contact with said adhesive coated face and removable from said protective sheet without removing said adhesive coating, said backing sheet having spine delineations and corner delineations corresponding to a range of book sizes, said spine delineations facilitating in use the removal of surplus portions of said protective sheet in the region of the ends of the spine, and said corner delineations facilitating in use the removal of surplus portions said protective sheet in the region of each corner of the book being covered, wherein said spine delineations which facilitate the removal of surplus portions at the spine comprise a first upper set and second lower set of spine markings, each set being arranged at the spine and cover boundaries, each of said first and second sets of spine markings comprising two series of spine markings, the series of spine markings in each set being arranged at complementary angles, one series being arranged to extend on a back cover area and being directed towards and onto a spine area, the other series being arranged to extend on to a front cover area and being directed towards and onto the spine area, wherein the backing sheet comprises three initially integral portions for applications to a front cover, spine and back cover of a book, said three portions being separately removable from the protective sheet by the provision of pre-formed lines defining the boundaries therebetween.

14. An article as claimed in claim 13, wherein said two series of markings in a set of spine delineations converge and meet in the spine area.

15. An article as claimed in claim 13, whereinsaid spine delineations which facilitate the removal of surplus portions at the cover corners comprise corner sets of linear markings extending across the respective corner, the corner markings being inclined to the longitudinal and lateral edges of the backing sheet and extending diagonally across the corner regions whereby these corner markings enable a cut to be made near to the corner, which cut is so inclined that the turned in adjoining flaps so formed are mitred.

* * * * *

UNITED STATES PATENT AND TRADEMARK OFFICE

CERTIFICATE OF CORRECTION

PATENT NO. : 4,863,191

DATED : September 5, 1989

INVENTOR(S) : Peter Termanis

It is certified that error appears in the above-identified patent and that said Letters Patent is hereby corrected as shown below:

Column 3, line 1, after "spine", insert -- delineations --.
Column 4, line 13, after "The", insert -- protective --;
line 17, change "cover" to -- corner --; and
line 18, after "grid 50", insert -- (to be further described) --.
Column 5, line 52, after "grid 50", insert -- are now further described --.
Claim 2, line 2, after "set of", insert -- spine --; and
line 3, change "thereby" to -- thereof --.
Claim 3, line 2, after "are" insert -- linear and --.

Signed and Sealed this

Twenty-seventh Day of November, 1990

*Attest:*

HARRY F. MANBECK, JR.

*Attesting Officer*

*Commissioner of Patents and Trademarks*